United States Patent [19]

Kohara

[11] 3,986,755

[45] Oct. 19, 1976

[54] MEANS FOR MOUNTING SEWING MACHINE IN CABINET

[75] Inventor: Tadao Kohara, Osaka, Japan

[73] Assignee: Maruzen Sewing Machine Co., Ltd., Osaka, Japan

[22] Filed: Aug. 25, 1975

[21] Appl. No.: 607,197

[52] U.S. Cl. ..... 312/21; 312/26; 312/27

[51] Int. Cl.[2] ..... A47B 81/00

[58] Field of Search ..... 312/21, 22, 24, 26, 312/27

[56] References Cited

UNITED STATES PATENTS

| | | | |
|---|---|---|---|
| 153,438 | 7/1874 | Jones | 312/27 |
| 484,401 | 10/1892 | Bolton | 312/27 |
| 791,010 | 5/1905 | Craig | 312/26 |
| 2,585,566 | 2/1952 | Lundstrom | 312/27 |
| 2,790,689 | 4/1957 | Hubbell | 312/21 |
| 2,977,170 | 3/1961 | Hochman | 312/26 |
| 3,712,667 | 1/1973 | Weber | 312/21 |
| 3,759,595 | 9/1973 | Current | 312/27 |
| 3,788,716 | 1/1974 | Roberts et al. | 312/22 |
| 3,870,386 | 3/1975 | Shepherd | 312/21 |

FOREIGN PATENTS OR APPLICATIONS

| | | | |
|---|---|---|---|
| 31,736 | 11/1961 | Finland | 312/22 |
| 36,923 | 3/1968 | Finland | 312/22 |

*Primary Examiner*—Paul R. Gilliam
*Assistant Examiner*—Victor N. Sakran
*Attorney, Agent, or Firm*—Arnstein, Gluck, Weitzenfeld & Minow

[57] ABSTRACT

A hinge assembly for mounting a sewing machine in a cabinet. The hinge assembly guides the machine for vertical movement to be selectively supported on the cabinet in two different positions corresponding to free arm and flatbed modes of operation. Additionally, the hinge assembly guides the machine to a position within the cabinet for storage.

3 Claims, 5 Drawing Figures

MEANS FOR MOUNTING SEWING MACHINE IN CABINET

BACKGROUND OF THE INVENTION

This invention relates to means for mounting a sewing machine on a cabinet for selective use in a flatbed or free arm mode, as well as for storage. The sewing machine per se with which the present invention is used embodies novel features which permit selective conversion of the machine from a flatbed type to a free arm type machine. The machine per se forms no part of the present invention and is the subject of a separate application for patent.

SUMMARY OF THE INVENTION

It is an object of the present invention to provide novel means for mounting a sewing machine in a conventional sewing machine cabinet whereby the machine may be selectively supported in two different modes for flatbed or free arm use, as well as in storage position.

Another object of this invention is the provision of a novel hinge assembly for use in combination with a sewing machine of the type described and a conventional cabinet, the hinge assembly controlling the attitude of the machine for use in a flatbed or free arm mode, as well as for storage within the cabinet.

Other and further objects and advantages of this invention will become apparent from the following description.

BRIEF DESCRIPTION OF A PREFERRED EMBODIMENT

Figure 1:
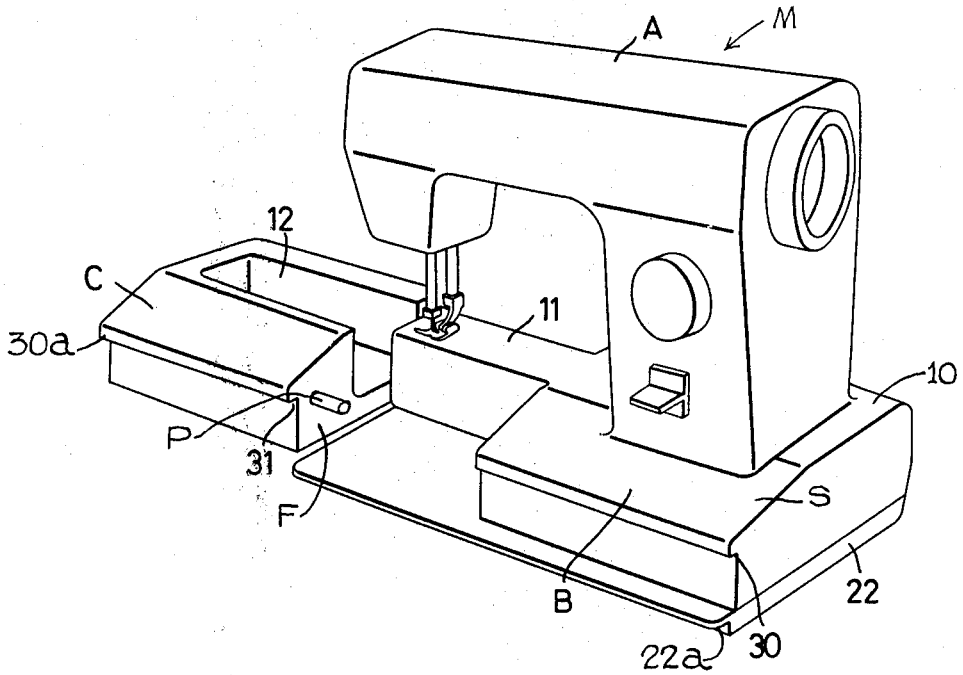
FIG. 1 is a perspective view of a convertible sewing machine of the type utilized with my invention, showing the components in exploded relation.

Referring to FIG. 1 there is illustrated a sewing machine which is convertible for use either as a free arm or as a flatbed type. This machine forms no part of the present invention but for a clearer understanding of the invention, certain features of the machine will be described briefly below.

The machine M comprises a hollow base B, shaped substantially as shown and having a work supporting surface or bed plate S. Secured to the base B is a head A which includes a vertically disposed hollow standard carrying an overhanging arm terminating in a hollow head in which is mounted a recipricatory needle bar and presser bar. The base B is generally T-shaped in plan and includes a main body portion 10 and a longitudinally extending integral arm 11 of reduced width disposed in vertical registration of the overhanging arm A. Conventional loop taker and feed mechanisms, not shown, are housed within the base B. The body portion

10 of base B includes a forward downwardly inclined work surface having an overhanging flange 30 forming a longitudinally extending shoulder.

Base B is supported on a rectangular platform plate 22 having an overhanging flange **22*a* co-extensive with its forward edge and providing a longitudinally extending shoulder. While the main body portion 10 of base B is supported on the plate 22 the bottom wall of arm 11 is spaced upwardly from the base plate 22 so as to provide clearance between the arm 11 and plate 22** to permit the machine to function in a free arm mode, as will be hereinafter explained.

A base shoe C shaped substantially as illustrated in FIG. 1 is constructed to be complemental to base B. Said shoe includes a recess 12 adapted to receive the arm 11 and an inclined work surface having an overhanging flange **30*a*. When the shoe C is assembled to the base B, the respective horizontal and inclined surfaces of the base and shoe are in coplanar registration affording a continuous work supporting surface and also a continuous longitudinally extending shoulder 30, 30*a*** for a purpose as will be hereinafter explained. The shoe C is provided with at least two pins P which project from the side face F, the pins being adapted to be received in cooperating holes in the confronting face of base B for purposes of alignment and securement of the shoe C to base B.

Figure 4:
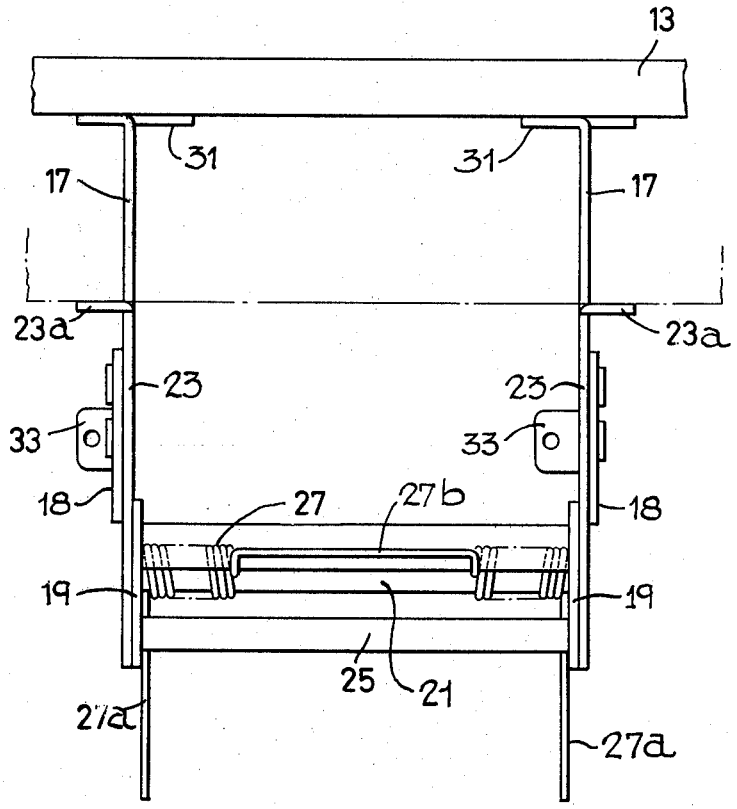
FIG. 4 is an elevational view, on an enlarged scale, of the hinge assembly.

The hinge assembly of my invention comprises a pair of brackets 17, 17 preferably formed of sheet metal and provided with integral top and rear lugs 31 and 33, respectively. Each of the lugs is perforated to receive screw means for fastening the bracket to the underside of the top and rear panels of a conventional sewing machine cabinet D. Integral lugs 32 on the brackets 17, 17 provide stops for limiting the upward movement of the links, hereinafter to be described. It will be understood that the pair of brackets 17, 17 are allochiral and in spaced relationship, as illustrated in FIG. 4.

Figure 2:
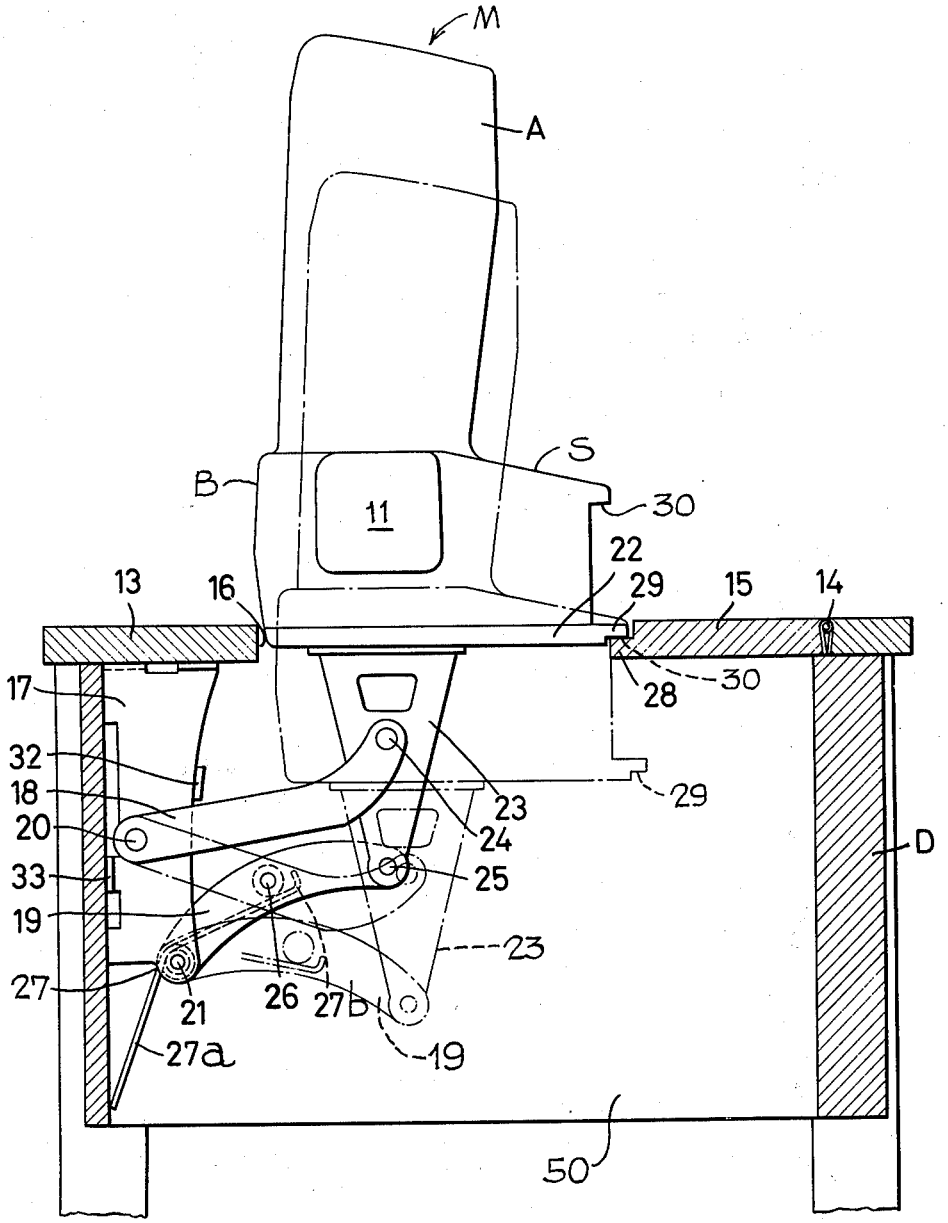
FIG. 2 is a vertical cross-sectional view through a sewing machine cabinet with the hinge assembly of my invention mounted thereon and showing in solid and broken lines the machine disposed in free arm and flatbed modes of operation.
Figure 5:
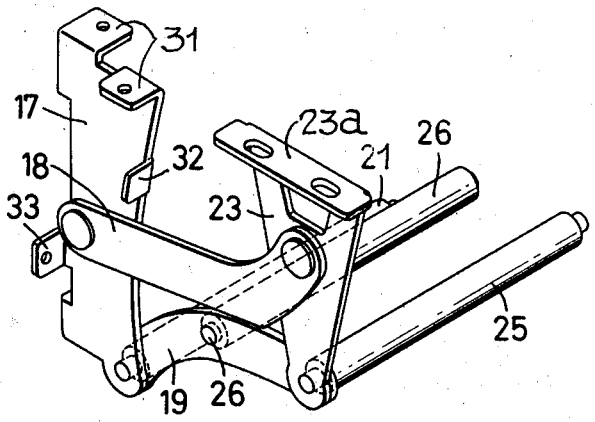
FIG. 5 is a partial perspective view of the hinge assembly.

Each of a pair of brackets 23, 23 also formed of sheet metal is provided with a laterally bent flange **23*a* which is perforated to receive fastening elements which secure the brackets 23, 23 to the underside of plate 22. The brackets 23, 23 are secured to the brackets 17, 17 by two pairs of links 18, 18 and 19, 19. The links 18, 18 are formed of sheet metal and shaped substantially as illustrated in FIGS. 2 and 5. Each of the links 18 is perforated at its ends and secured to respective brackets 17 and 23 substantially medially thereof. The links 19, 19 are similarly formed of sheet metal and are generally arcuate in shape. The links 19, 19 are pivotally connected to the brackets 17 and 23 by spacer bars 21 and 25 respectively, which have reduced ends received in perforations in the links 19, 19 and brackets 17 and 23. As seen in FIGS. 4 and 5, the links 18 and 19 are arranged on opposite sides of the brackets 17 and 23 in order to avoid interference in the movement of the parts relative to each other. A spacer bar 26 is connected to the links 19 substantially medially thereof. It will be understood that the reduced ends of the bars 24, 25 and 26 which extend through the perforations of the brackets 17 and 23 are peened over to effect securement of the parts while permitting relative pivotal movement. A torsion spring 27 formed in two connected sections, as illustrated in FIG. 4, has two coils circumposed about the bar 21 and includes oppositely directed radially extending arms 27*b* and 27*c*, the lower arms 27*a* abutting against the rear wall of the cabinet D while the upper arms 27*b* engage the transverse bar 26. The spring 27 provides a counter-effect against the weight of the sewing machine M supported on the brackets 23, 23** to assist the operator in elevating the machine to its operative positions, as will be hereinafter explained.

Referring to FIG. 2, cabinet D is of generally conventional construction and includes a table top 13 fixed to the frame of the cabinet, the top 13 being provided with a rectangular cut-out 16 and having a movable panel 15 extending the full width of the cut-out and hinged as at 14 to the table top 13. Suitable stop elements, not shown, are secured to the side walls of the cabinet D for supporting the panel 15 in a horizontal position. The panel 15 is provided along its free edge with a recessed shoulder 28 arranged to receive either of the flanges 29 or 30, as will be hereinafter explained.

As indicated by the solid lines in FIG. 2, the machine M is shown in its uppermost position with the flange 29 supported on the shoulder 28 and, in this position, the machine may be operated in a free arm mode after the shoe C is separated from the machine by sliding the same laterally as illustrated in FIG. 1. It will be noted that in this position the bottom of the arm 11 is disposed above the surface of the table top 13 and panel 15 affording desired clearance for operation of the machine in a free arm mode.

In order to convert the machine to operation in a flatbed mode the machine M is elevated a short distance just sufficient to permit the operator to tilt panel 15 upwardly clear of the flange 29. Thus, the opening is enlarged to permit the machine M to be lowered into the space of the cabinet. After the flange 29 clears the level of the table top 13, the panel 15 is permitted to resume its normal horizontal at rest position so that when the machine M is further lowered the flange 30 will engage the shoulder 28 and the machine will be supported in a flatbed mode, as illustrated by the broken lines in FIG. 2. It will, of course, be understood that in such mode the shoe C is assembled with the machine M so as to afford a continuous work supporting surface.

It will be seen that the links 18, 18 and 19, 19 control the movement of the machine M in a vertical direction so that the machine in being moved from the solid line to the broken line position, and vice versa, maintains a generally erect position, although it will be seen that there will be a slight forward shifting of the machine when it is moved from the free arm position (solid lines, FIG. 2) to the flatbed position, (broken lines, FIG. 2) it being noted that the flange 29 extends forwardly of the flange 30. While the clearance between the rear edge of the opening 16 and the rear face of the machine M will be greater when the machine is in the flatbed position than when it is in the free arm position, the engagements of the flanges 29 and 30 with the shoulder 28 are substantially the same.

Figure 3:
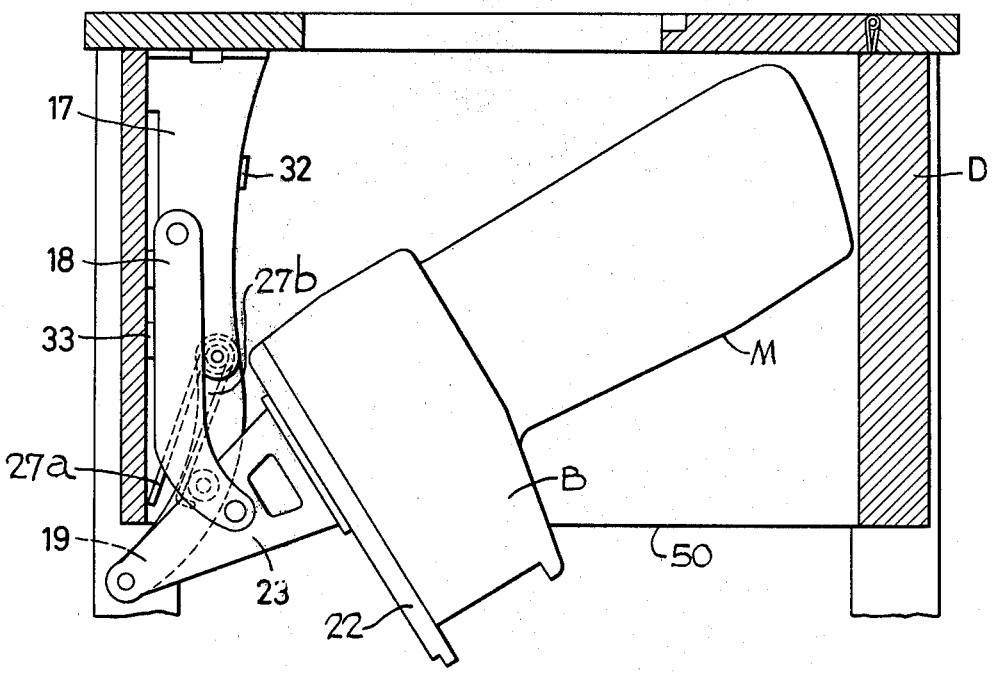
FIG. 3 is a view similar to FIG. 2 showing the machine disposed in storage position within the cabinet.

In order to move the machine M to storage position within the compartment 50 of cabinet D, the machine M is elevated to provide clearance to permit tilting of the panel 15 upwardly to provide sufficient clearance for the movement of the machine downwardly into the compartment 50 to assume the storage position illustrated in FIG. 3. It will be noted that the arrangement of the links 18 and 19 permits the machine to be tilted substantially diagonally of the compartment 50 with the links 18, 18 and 19, 19 being vertically orientated. When the machine has been dropped into storage position the panel 15 is returned to its normal horizontal position and a conventional cover member, not shown, is superposed over the tabletop 13 and panel 15.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In combination a sewing machine cabinet and a sewing machine adapted to be selectively operable in two work positions corresponding to a flat bed mode or free arm mode of operation, the base of said sewing machine having two forward horizontally extending flanges in vertically spaced relation, each related to a particular work position, said cabinet having a back, a pair of side walls, a front wall and a table top having an opening therein, a storage compartment positioned below said opening, a panel hinged to said table top adjacent said opening and normally disposed coplanar with said table top but swingable upwardly to enlarge said opening to allow the machine to pass therethrough, said panel when disposed coplanar with said table top cooperating with a selected one of said flanges to support said machine in one selected work position a first pair of spaced brackets secured to a surface of said compartment rearwardly of said opening, a second pair of spaced brackets secured to said machine in depending relation thereto, first and second pairs of parallel links pivotally connected at respective ends to said first and second pairs of brackets, said links controlling the movement of said machine in a vertical direction whereby the machine is maintained in an erect attitude in the course of such movement from a lowered work position to a raised work position and vice versa relative to said table top.

2. The invention as defined in claim 1 wherein the links are so constructed and arranged as to effect an inclination of the machine towards the front wall when the machine is moved to storage position within the compartment.

3. In combination a sewing machine cabinet and a sewing machine adapted to be selectively operable in two work positions corresponding to a flat bed mode or free arm mode of operation, the base of said sewing machine having two forward horizontally extending flanges in vertically spaced relation, each related to a particular work position, said cabinet having a back, a pair of side walls, a front wall and a table top having an opening therein, a storage compartment positioned below said opening, a panel hinged to said top adjacent said opening and normally disposed coplanar with said table top but being swingable upwardly to enlarge said opening to allow the machine to pass therethrough, said panel when disposed coplanar with said table top cooperating with a selected one of said flanges to support said machine in one selected work position a first pair of brackets secured to the rear wall of said compartment rearwardly of said opening, a second pair of spaced brackets secured to said machine in depending relation thereto, an upper pair of parallel links pivotally connected to said first and second pairs of brackets, a lower pair of parallel links pivotally connected to said first and second pairs of brackets, a bar extending between said lower pair of links and coaxial with each pivotal connection, said links controlling the movement of said machine in a vertical direction whereby the machine is maintained in an erect attitude in the course of such movement from a lowered work position to a raised work position and vice versa relative to said table top, said machine being supported in a selected work position by resting a respective one of said flanges on the distal edge of hinged panel, and torsion spring means carried on one of said bars for assisting in elevating said machine to either of said work positions.

* * * * *